US011105485B2

(12) United States Patent
Kothari

(10) Patent No.: US 11,105,485 B2
(45) Date of Patent: Aug. 31, 2021

(54) LED LIGHTING SYSTEM IN INFLATABLE TOWER

(71) Applicant: Ramanlal Kishandas Kothari, Maharashtra (IN)

(72) Inventor: Ramanlal Kishandas Kothari, Maharashtra (IN)

( * ) Notice: Subject to any disclaimer, the term of this patent is extended or adjusted under 35 U.S.C. 154(b) by 0 days.

(21) Appl. No.: 16/718,563

(22) Filed: Dec. 18, 2019

(65) Prior Publication Data

US 2020/0393107 A1 Dec. 17, 2020

(30) Foreign Application Priority Data

Jun. 11, 2019 (IN) ..... 201921023116

(51) Int. Cl.

| | |
|---|---|
| ***F21V 3/02*** | (2006.01) |
| ***F21V 33/00*** | (2006.01) |
| *F21Y 115/10* | (2016.01) |
| *F21W 121/00* | (2006.01) |

(52) U.S. Cl.

CPC ..... *F21V 3/026* (2013.01); *F21V 33/0088* (2013.01); *F21W 2121/00* (2013.01); *F21Y 2115/10* (2016.08)

(58) Field of Classification Search

CPC .. A63H 2027/1033; A63H 27/10; F21V 1/06; F21V 3/023; F21V 3/026; F21V 33/0088; F21W 2121/00; F21Y 2115/10

See application file for complete search history.

(56) References Cited

U.S. PATENT DOCUMENTS

| | | | | |
|---|---|---|---|---|
| 6,322,230 | B1 * | 11/2001 | Medici | F21S 9/022 340/321 |
| 6,966,676 | B2 * | 11/2005 | Chabert | F21V 3/023 362/352 |
| 7,611,395 | B2 * | 11/2009 | Bonsembiante | A63H 27/10 362/253 |
| 7,641,351 | B2 * | 1/2010 | Girolami | F21V 3/026 362/96 |
| 8,613,527 | B1 * | 12/2013 | Allen | F21V 3/026 362/234 |
| 2004/0066648 | A1 * | 4/2004 | Tambini | F21V 3/023 362/101 |
| 2008/0106888 | A1 * | 5/2008 | Nalitchaev | F21V 3/023 362/96 |

(Continued)

FOREIGN PATENT DOCUMENTS

| | | | | |
|---|---|---|---|---|
| WO | WO2011151753 | * 12/2011 | ..... | F21S 8/00 |

OTHER PUBLICATIONS

English Machine translation for WO2011151753A1 provided ESPACENET (Year: 2011).*

*Primary Examiner* — Zheng Song
(74) *Attorney, Agent, or Firm* — SZDC Law PC

(57) ABSTRACT

Disclosed is a lighting tower (100) with a Light Emitting Diode (LED) (106). The lighting tower (100) comprises a Base Unit (102), an inflatable balloon (104), a blower (108), and a stabilizing rod (114). The inflatable balloon (104) is coupled to the Base Unit (102). The LED array (106) coupled to a top end of the inflatable balloon (104) with inward facing of the LED (106) in the inflatable balloon (104). In one aspect, the blower (108) lifts up the inflatable balloon (104) with the LED array (106). In another aspect, the blower (108) simultaneously controls a temperature at a junction of the LED (106).

3 Claims, 2 Drawing Sheets

(56) References Cited

U.S. PATENT DOCUMENTS

| | | | | |
|---|---|---|---|---|
| 2008/0291681 | A1* | 11/2008 | Appleton | F21V 3/023 362/307 |
| 2009/0133299 | A1* | 5/2009 | Blackwell | G09G 3/14 40/212 |
| 2009/0141491 | A1* | 6/2009 | Chu | G09F 21/06 362/231 |
| 2012/0287615 | A1* | 11/2012 | Kothari | F21L 13/00 362/192 |

* cited by examiner

LED LIGHTING SYSTEM IN INFLATABLE TOWER

CROSS-REFERENCE TO RELATED APPLICATIONS AND PRIORITY

The present application claim priority from Indian patent application 201921023116 submitted on 11 Jun. 2019, the entirety of which is hereby incorporated by reference.

TECHNICAL FIELD

The present disclosure in general relates to a lighting tower. More particularly, the present disclosure further relates to an inflatable lighting tower with the help of balloon especially designed for the LED and stabilizing rod and sound damping utilizer.

BACKGROUND

Generally, a conventional inflatable lighting tower comprises a metal halide or any High Intensity Discharge (HID) lamp. The metal halide lamps in the inflatable lighting tower may take approximately 5 to 10 minutes to glow, when switched ON. Also Metal Halid Light cannot glow till it will cool up to certain temperature. This disadvantage of HID can be overcome with the LED technology which is energy efficient also LED lamp will instantly ON/OFF.

SUMMARY

It is to be understood, that this application is not limited to the particular systems, and methodologies described, as there can be multiple possible embodiments, which are not expressly illustrated, in the present disclosure. It is also to be understood that the terminology used in the description is for the purpose of describing the particular versions or embodiments only, and is not intended to limit the scope of the present application. This summary is provided to introduce concepts related to a lighting tower. This summary is not intended to identify essential features of the claimed subject matter nor is it intended for use in determining or limiting the scope of the claimed subject matter.

In one implementation, a lighting tower is illustrated. The lighting tower may comprise a Base Unit, an inflatable balloon, a blower, and a stabilizing rod. The inflatable balloon may be coupled to the Base Unit. The inflatable balloon further comprises a LED light fixture coupled to a top end of the inflatable balloon and may be facing inside the inflatable balloon. The blower may be located inside the Base Unit and at a centre of the Base Unit. In one implementation, during operation the blower may be configured to inflate the inflatable balloon by blowing air into the inflatable balloon. The blower may further lift the inflatable balloon along with the LED Light Structure and may control a temperature of LED array. The stabilizing rod may be configured to support the lighting tower. In one embodiment, one end of the stabilizing rod may be fixed to a top portion of the Base unit. In another embodiment, other end of the stabilizing rod may be hooked to the inflatable balloon.

BRIEF DESCRIPTION OF DRAWINGS

The detailed description is described with reference to the accompanying figures. In the figures, the left-most digit(s) of a reference number identifies the figure in which the reference number first appears. The same numbers are used throughout the drawings to refer like features and components.

DETAILED DESCRIPTION

Some embodiments of the present disclosure, illustrating all its features, will now be discussed in detail. The words "facing", "during", "blowing" and other forms thereof, are intended to be open ended in that an item or items following any one of these words is not meant to be an exhaustive listing of such item or items, or meant to be limited to only the listed item or items. It must also be noted that as used herein and in the appended claims, the singular forms "a", "an" and "the" include plural references unless the context clearly dictates otherwise. Although any systems and methods similar or equivalent to those described herein can be used in the practice or testing of embodiments of the present disclosure, a lighting tower is now described. The disclosed embodiment of the lighting tower is merely exemplary of the disclosure, which may be embodied in various forms.

Various modifications to the embodiment will be readily apparent to those skilled in the art and the generic principles herein may be applied to other embodiments. However, one of ordinary skill in the art will readily recognize that the present disclosure a lighting tower is not intended to be limited to the embodiments illustrated, but is to be accorded the widest scope consistent with the principles and features described herein.

The present subject matter discloses a lighting tower comprising a Base Unit, an inflatable balloon, a blower, and a stabilizing rod. The inflatable balloon may be coupled to the Base Unit. The inflatable balloon may comprise a light weight properly designed complete structure of LED light coupled to the top end of inflatable balloon. It is to be noted that the whole LED lamp covered inside the inflatable balloon. The inflatable balloon may be inflated by a blower to form the lighting tower. The blower may be located inside the Base Unit. In one implementation, the blower may be located at a centre of the Base Unit. The blower may lift the inflatable balloon along with the LED light structure also it create the air turbulence inside the LED light Structure which helps to maintain the temperature of LED array for long life span & efficiency of LED array In one embodiment, the stabilizing rod may be used to support the lighting tower and prevent the lighting tower from toppling in case of a wind condition or in condition of any type of failure. During implementation, one end of the stabilizing rod is fixed to a top portion of the Base Unit and other end is hooked to the inflatable balloon in order to provide rigid support to the lighting tower. While aspects of described system and method for the lighting tower may be implemented in any number of different computing systems, environments, and/or configurations, the embodiments are described in the context of the following exemplary system.

Figure 1:
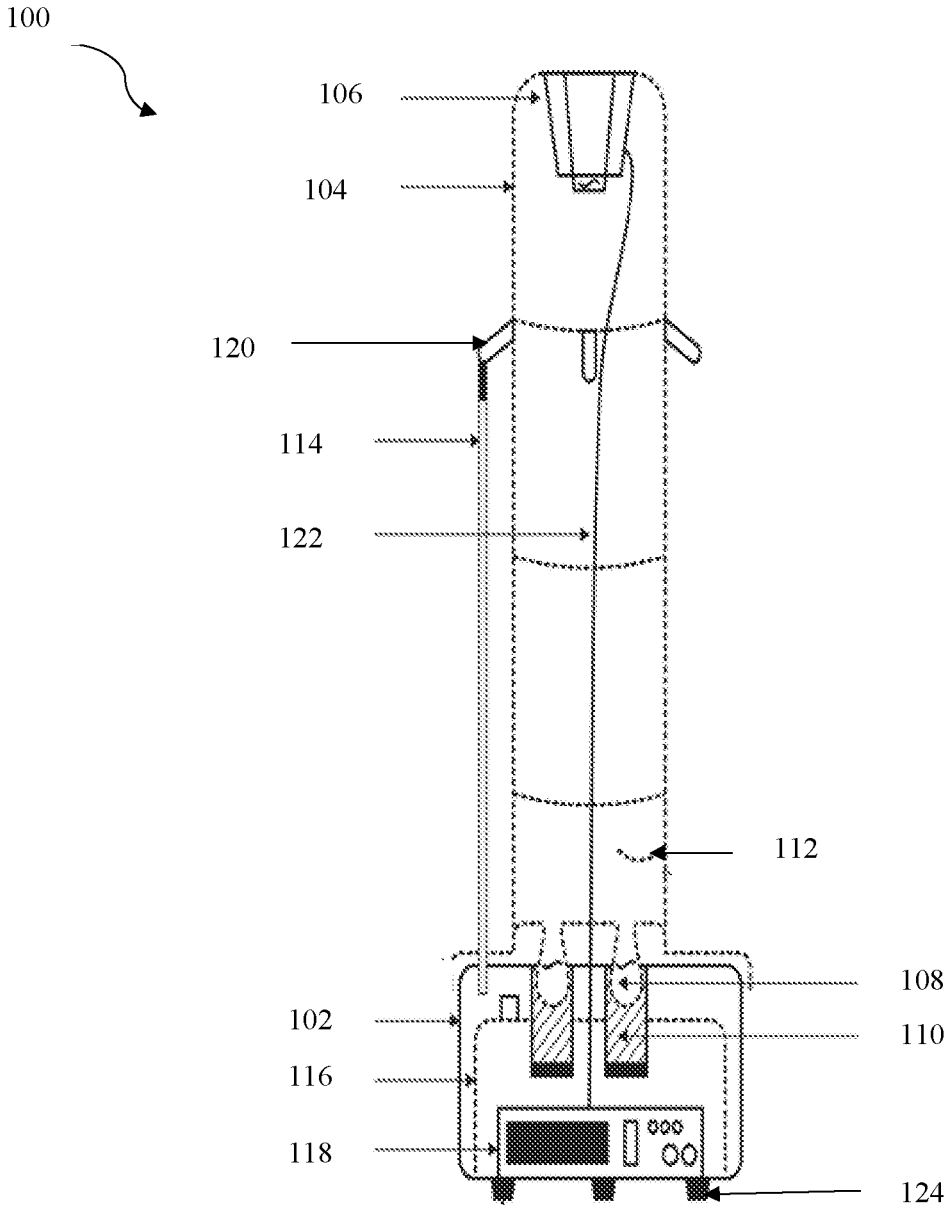
FIG. 1 illustrates a schematic view of a lighting tower, in accordance with an embodiment of the present subject matter.
Figure 2:
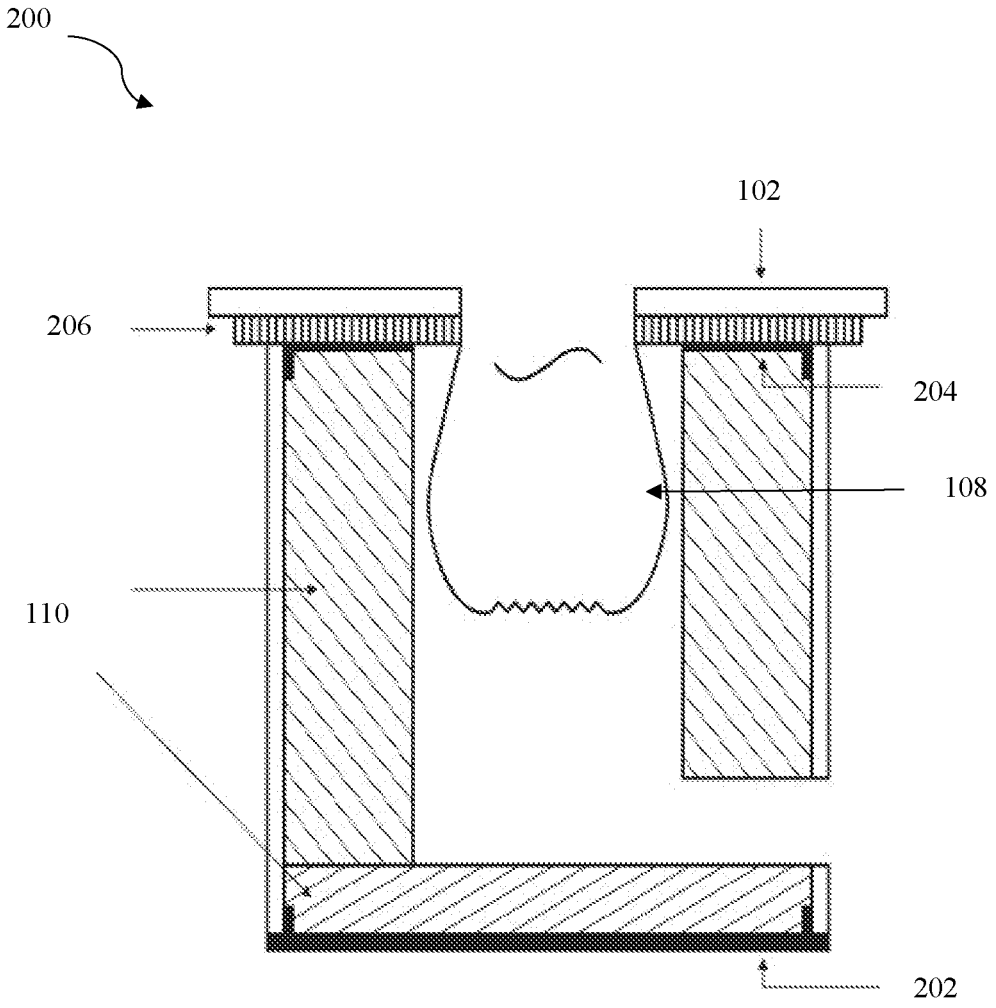
FIG. 2 illustrates a schematic view of a Blower Housing Unit of a lighting tower comprising a sound damping insulator, in accordance with an embodiment of the present subject matter.

Now, referring to FIGS. 1 and 2, various elements of a lighting tower 100 in accordance with an embodiment of the present subject matter is illustrated. In one embodiment, the lighting tower 100 comprises a Base Unit 102, an inflatable balloon 104, a blower 108, and a stabilizing rod 114. In one aspect, the inflatable balloon 104 is coupled to the Base Unit 102. The inflatable balloon 104 may further comprise a properly fixed LED Light Structure 106 coupled to a top end of the inflatable balloon 104 and facing inside the inflatable balloon 104. The inflatable balloon 104 may be made by one of materials such as nylon fabric, polychloroprene and the like rips top spinnaker in white colour to provide defused light and rain protection to light.

The LED Light Structure 106 comprises a specially designed aluminium structure on which Quality LED array mounted on thermally conductive Printed Circuit Board and light weight metal heat sink (to increase area of heat conduction). Proper epoxy coating to protect LED array from the all type of weather conditions. The shape of the structure is so designed to spread maximum light on ground and cut off the upside going light.

The blower 108 may inflate the inflatable balloon 104. The blower 108 may be located inside the Base Unit 102 and at a centre of the Base Unit 102. Further, the Base Unit 102 may comprise a motor in order to operate the blower 108. In one example, the motor may be located inside the blower 108 and at a centre of the blower 108. In another example, motor and blower may be located outside the base unit coupled to inflatable tower. Furthermore, the LED Light fixture 106 may receive a DC power supply with a range less than 60 volt in order to operate and AC power for the motor. All A/c Switches, Circuit Breaker unit, required Number of Universal Converter with short circuit protection to give DC supply to LED array and A/c Supply to the blower motor properly and safely installed in the Electrical Distribution Box 118. DC and AC power supply may be provided by a generator 116.

In addition, the Base Unit 102 may comprise a primary ring 202 to seal a bottom part of the Base Unit 102 to avoid air leakage. The primary ring may be made of polytetrafluoroethylene, polyurethane, rubber and the like. The Base Unit 102 may comprise a secondary ring 204 located between a sound damping insulator 110 and a sound absorbing material sheet 206. The sound damping insulator 110 may be made of acoustic foam and other insulators, acoustic fabric panels, hanging baffles, any sound absorbing material and the like. The Sound absorber sheet 206 may be located between the secondary ring 204 and at an inner surface of a top portion of the Base Unit 102. The Base Unit 102 may have plurality of stabilizing legs 124 mounted at a bottom portion of the Base Unit 102 in order to avoid toppling of the lighting tower 100 during strong winds also control the vibration of the base unit. A bottom end of the inflatable balloon 104 may be coupled to a top portion of the Base Unit 102. The Base Unit 102 may be placed on a ground. The Base Unit may be made of carbon fibre, iron, steel and the like. The Base Unit 102 comprising the sound damping insulator 110 surrounds the blower 108 and a motor (not shown).

During operation, Regular technique of managing temperature of LED array is by increasing metallic surface directly connected to LED(s) generally called as heat sink. The heat generates at the LED(s) Junction will then dissipates the heat via that extended surface of heat sink into surrounding atmosphere. When one used the higher power LED the heat generated determinately affect the unit life span and reduces the operational efficiency. To manage such heat one should use heavy heat sink. This technique of cooling is called as passive cooling. But using heavy heat sink will make the light heavy and difficult to lift with inflatable balloon.

To overcome the above problem here we develop such as light weight properly designed structure of LED panel with minimum heat sink and by air turbulence created in the fixture 106 the blowing air may manage temperature of LED array. This technique of cooling is called as active cooling. This active cooling is without using any extra air source.

In one another aspect, the lighting tower 100 may have the stabilizing rod 114. The stabilizing rod 114 may be used to support the lighting tower 100. Further, one end of the stabilizing rod 114 is affixed in a rod holding hole on the top portion of the Base Unit 102 and other end may be hooked to a centre of the inflatable balloon 104. The inflatable balloon 104 may have a rod holding plate 120 mounted at an outer surface. In one implementation, the lighting tower 100 may comprise a set of rod holding plate 120 mounted on an outer circumference of the inflatable balloon 104. The rod holding plate 120 may be made of plastic, iron, steel and the like. The rod holding plate 120 may hold the other end of the stabilizing rod 114. In another implementation, the lighting tower 100 may comprise one or more stabilizing rod 114 coupled to the set of rod holding plate 120 or sand balloons tied to provide extra support to light tower (not shown). The stabilizing rod 114 may provide a rigid support to the lighting tower 100 in order to prevent from heavy winds and hold the inflatable balloon along with the LED light fixture to that height itself in case of any failure of power or Blower fan.

In one embodiment, the stabilizing rod 114 may be of iron, steel and the like. The stabilizing rod 114 is used to hold the lighting tower 100 in a straight position in order to provide strength during strong winds, thus preventing toppling of the lighting tower 100. The lighting tower 100 may be used in emergency lighting in different areas, construction sites like highways, bridges, tunnels and the like, search and rescue operations, disaster management like fir, flood and earthquake, lighting solutions for railways, large institutions airports, hotels and the like.

In another implementation, the lighting tower 100 comprising the inflatable balloon 104 may have a means 112 for deflating the inflatable balloon 104 filled with air. The means 112 may be located at an outer surface of the inflatable balloon 104. In one example, the means 112 may be a chain. A user may unzip the chain in order to remove the air from the inflatable balloon 104, of the lighting tower 100. In another example, the means 112 may be a hole and a Velcro™. The user may remove the Velcro™ in order to remove the air via the hole, thereby deflating the inflatable balloon 104 filled with air. In another example, the means may be a valve. The user may open the valve to deflate the inflatable balloon 104.

Exemplary embodiments discussed above may provide certain advantages, these advantages may include the following.

Some embodiments of the lighting tower 100 may enable the blower to simultaneously provide cooling effect to the LED 106 and inflate the inflatable balloon 104 thereby reducing overall weight of the lighting tower 100.

Some embodiments enable the lighting tower 100 to be portable.

Some embodiments enable the lighting tower 100 to provide maximum illumination for a longer period without damaging the LED 106.

Some embodiments enable the lighting tower 100 to illuminate 360 degrees area.

Some embodiments enable the lighting tower 100 to reduce energy consumption for same illumination compared to metal halide or HED lights.

Some embodiments enable the lighting tower 100 to dampen the noise created by the blower 108 and the motor.

Some embodiments enable the lighting tower 100 to be waterproof.

Some embodiments enable the lighting tower 100 to lit instantly.

Some embodiments enable the lighting tower 100 power efficient.

Although implementations for the lighting tower 100 have been described in language specific to structural features and/or methods, it is to be understood that the appended claims are not necessarily limited to the specific features or methods described. Rather, the specific features and methods are disclosed as examples of implementations for the lighting tower 100.

The invention claimed is:

1. A lighting tower (100), the lighting tower (100) comprises:

a Base Unit (102);

an inflatable balloon (104) coupled to the Base Unit (102), wherein the inflatable balloon (104) comprises a Light Emitting Diode (LED) array (106), and wherein the LED array (106) is coupled to a top end of the inflatable balloon (104) and facing inside the inflatable balloon (104);

a stabilizing rod (114), wherein the stabilizing rod (114) is configured to support the inflatable balloon (104), and wherein one end of the stabilizing rod (114) is connected to a top portion of the Base Unit (102), and wherein another end of the stabilizing rod (114) is connected to a centre of the inflatable balloon (104), a rod holding plate (120), wherein the rod holding plate (120) is mounted at an outer surface of the inflatable balloon (104), and wherein the rod holding plate (120) is configured to hold other end of the stabilizing rod (114);

a blower (108) located inside the Base Unit (102), wherein during operation the blower (108) is configured to inflate the inflatable balloon (104) by blowing air in order to lift the inflatable balloon (104), and wherein the blower (108) is configured to control a temperature at a junction of the LED array (106); and a sound damping insulator (110) located inside the Base Unit (102), wherein the sound damping insulator (110) surrounds the blower (108) and a motor, wherein the motor is configured to operate the blower (108), wherein the Base Unit (102) comprises a secondary ring (204) located between the sound damping insulator (110) and sound absorbent sheets (206), wherein the sound absorbents sheet (206) is located between the secondary ring (204) and at an inner surface of a top portion of the Base Unit (102).

2. The lighting tower (100) as claimed in claim 1, wherein the inflatable balloon (104) comprises a means (112) for deflating the inflatable balloon (104), wherein the means (112) is located at the outer surface of the inflatable balloon (104) and the means (112) is a chain.

3. The lighting tower (100) as claimed in claim 1, wherein the Base Unit (102) comprises a primary ring (202) to seal a bottom part of the Base Unit (102).

* * * * *